US007591388B2

(12) United States Patent
Amormino

(10) Patent No.: US 7,591,388 B2
(45) Date of Patent: Sep. 22, 2009

(54) SPILL-RESISTANT CONTAINER

(76) Inventor: Philip Salvatore Amormino, 18916 Robinson Rd., Sonoma, CA (US) 95476

( * ) Notice: Subject to any disclaimer, the term of this patent is extended or adjusted under 35 U.S.C. 154(b) by 381 days.

(21) Appl. No.: 11/422,739

(22) Filed: Jun. 7, 2006

(65) Prior Publication Data

US 2007/0012701 A1 Jan. 18, 2007

Related U.S. Application Data

(60) Provisional application No. 60/698,546, filed on Jul. 12, 2005.

(51) Int. Cl.
*B65D 51/00* (2006.01)
*B65D 51/18* (2006.01)

(52) U.S. Cl. ..... 220/229; 220/288

(58) Field of Classification Search ..... 220/229, 220/253, 288, 796
See application file for complete search history.

(56) References Cited

U.S. PATENT DOCUMENTS

| | | | | | |
|---|---|---|---|---|---|
| 571,708 | A * | 11/1896 | Thompson | 137/845 |
| 1,150,080 | A * | 8/1915 | Tissue | 220/6 |
| 1,629,661 | A | 5/1927 | Gerhard | |
| 1,983,139 | A | 12/1934 | Lovell | |
| 2,803,370 | A * | 8/1957 | Lennard | 220/229 |
| 3,061,080 | A | 10/1962 | Stephen | |
| 3,315,402 | A | 4/1967 | Scott et al. | |
| 4,328,904 | A | 5/1982 | Iverson | |
| 4,502,606 | A * | 3/1985 | Shillington et al. | 215/274 |
| 4,679,700 | A | 7/1987 | Tharrington et al. | |
| 4,884,717 | A | 12/1989 | Bussard et al. | |
| 5,259,501 | A * | 11/1993 | Withers et al. | 206/366 |
| 5,676,990 | A | 10/1997 | Wawrzynski | |
| 5,964,533 | A * | 10/1999 | Ziglar | 383/36 |
| 5,988,468 | A | 11/1999 | Murdoch et al. | |
| 6,176,384 | B1 | 1/2001 | Voloshin | |
| 6,286,698 | B2 * | 9/2001 | Hague et al. | 215/201 |
| 6,656,514 | B1 | 12/2003 | Tubbs | |
| 7,396,176 | B2 * | 7/2008 | Schoemer | 401/12 |
| 2001/0035414 | A1 * | 11/2001 | Tyree | 220/229 |
| 2002/0139799 | A1 * | 10/2002 | Karaki et al. | 220/229 |
| 2002/0144915 | A1 * | 10/2002 | Atkinson et al. | 206/278 |
| 2003/0183630 | A1 * | 10/2003 | Schneider et al. | 220/9.2 |
| 2003/0196984 | A1 * | 10/2003 | Uchiyama | 215/247 |
| 2004/0067169 | A1 * | 4/2004 | Krause | 422/100 |
| 2004/0159658 | A1 * | 8/2004 | McLaughlin et al. | 220/4.21 |
| 2005/0263523 | A1 | 12/2005 | Moss | |
| 2007/0034592 | A1 * | 2/2007 | Pavlovic et al. | 215/253 |

* cited by examiner

*Primary Examiner*—Anthony D Stashick
*Assistant Examiner*—Niki M Eloshway
(74) *Attorney, Agent, or Firm*—Gianna G. Kelly

(57) ABSTRACT

A spill-resistant container having an open upper end that is maintained closed by a cover of flexible, elastic fabric, providing for quick, comfortable access to the containers contents. The cover is comprised of two overlapping pieces of elasticized fabric which may be easily pushed aside by a person's fingers reaching inside the container to access solid items therein. Once the person's hand is withdrawn from the opening, the two pieces of fabric snap shut, returning to their original overlapping positions and thereby closing the open end of the receptacle. Furthermore, the cover is detachably connected to the receptacle to permit cleaning and refilling of the receptacle.

1 Claim, 2 Drawing Sheets

SPILL-RESISTANT CONTAINER

CROSS-REFERENCE TO RELATED APPLICATIONS

This application claims the benefit of provisional patent application Ser. No. 60/698,546, filed 2005 Jul. 12 by the present inventor.

FEDERALLY SPONSORED RESEARCH

Not Applicable.

SEQUENCE LISTING OR PROGRAM

Not Applicable.

FIELD OF THE INVENTION

The present invention is directed to a spill-resistant container, specifically a spill-resistant container that both permits easy access to solid items, and retains these items within, even when dropped, tipped, or shaken.

BACKGROUND OF THE INVENTION

In our current busy, on-the go world people of all ages often have the need to carry small items in a container that allows them easy access to its contents, yet will not spill if the container is dropped, tipped, or shaken. While spill-proof lids in the beverage industry are well known, less development has been done of spill-proof lids directed to reducing spillage of dry food items or other small objects. Those that have been contemplated in the past use plastic or rubber materials to create flaps that flex to allow a person's fingers to enter and exit a container, the flaps then return to their original position.

Bussard in U.S. Pat. No. 4,884,717, "Non-Spilling Snack Container", describes a cover having crossing slits forming a circle of tongues, which flex downward when a user's fingers reach inside, thus forming a self-closing, dispensing opening through the cover. The "Anti-Spill Container" described in U.S. patent application Ser. No. 11/135,898 also contemplates flexible flaps made of various types of plastic. Similarly, Tubbs in U.S. Pat. No. 6,656,514, "Spill-Proof Lid and Container", describes a plurality of flexible, resilient flaps that extend inwardly toward the axis of the rim, again using a plastic or rubber material. Both of these approaches have several disadvantages:

A) The downward flexing flaps restrict access to the container by only allowing several fingers to pass through; and limit the level the container may be filled to thereby reducing storage capacity.

B) The use of plastic or rubber materials in the prior art results in hard edges which can cause slight abrasions or discomfort to the user's hand.

While prior art teaches a variety of spill-proof lids, it does not teach that a singular slit made from elasticized, synthetic fabric may form a flexible, self-closing opening. As the following summary will demonstrate, the present invention improves on the prior art in several key ways:

A) The elastic fabric provides a smooth, soft surface through which the user passes their hand, greatly increasing their comfort.

B) Unlike the flexible flaps, the action of the elastic slit is such that as the hand passes through the opening, the elastic fabric is deformed horizontally, along the same plane as the fabric itself, thus eliminating the obstruction that is created by flexible flaps that are pushed vertically into the container along with the hand.

C) The present invention allows the hand to exit the opening just as easily as it enters, the elasticized fabric offers little resistance to the movement of the hand in either direction. Closures constructed of a plurality of flexible flaps restrict the withdrawal of the hand because of their inherent stiffness (which is required for them to retain some spill-proof quality) and tendency to close on the hand or fingers as they are being withdrawn.

SUMMARY OF THE INVENTION

It is the primary object of the present invention to provide a container for holding solid items such as dry snack food, paperclips, coins, or children's toys which allows a person's hand to pass through a comfortable opening to retrieve some of the items therein and which automatically closes itself after the hand is withdrawn so that if the container is tipped, dropped, or shaken no items will spill out.

The spill-resistant container contemplated includes a cover, detachably connected to a receptacle and a means for coupling this cover to the receptacle. The cover comprises two members of elasticized fabric, one overlapping the other, suspended between two annuli. The overlap of the fabric members forms a placket through which a person's hand may pass.

The means for coupling may be integrated with the annuli or, may be a separate unit entirely. Additionally, the means for coupling may be screwed or snapped on to the open end of the receptacle.

The receptacle, annuli, and means for coupling are preferably made of plastic. Preferable materials for the elasticized fabric members include: nylon Spandex, polyester Spandex, and DOW XLA™ fiber.

BRIEF DESCRIPTION OF THE DRAWINGS

The best mode, currently contemplated for the present invention, is illustrated in the following description taken in conjunction with the appended drawings, in which reference numbers designate the same parts throughout the several views, and wherein.

DRAWINGS' REFERENCE NUMERALS

Figure 1:
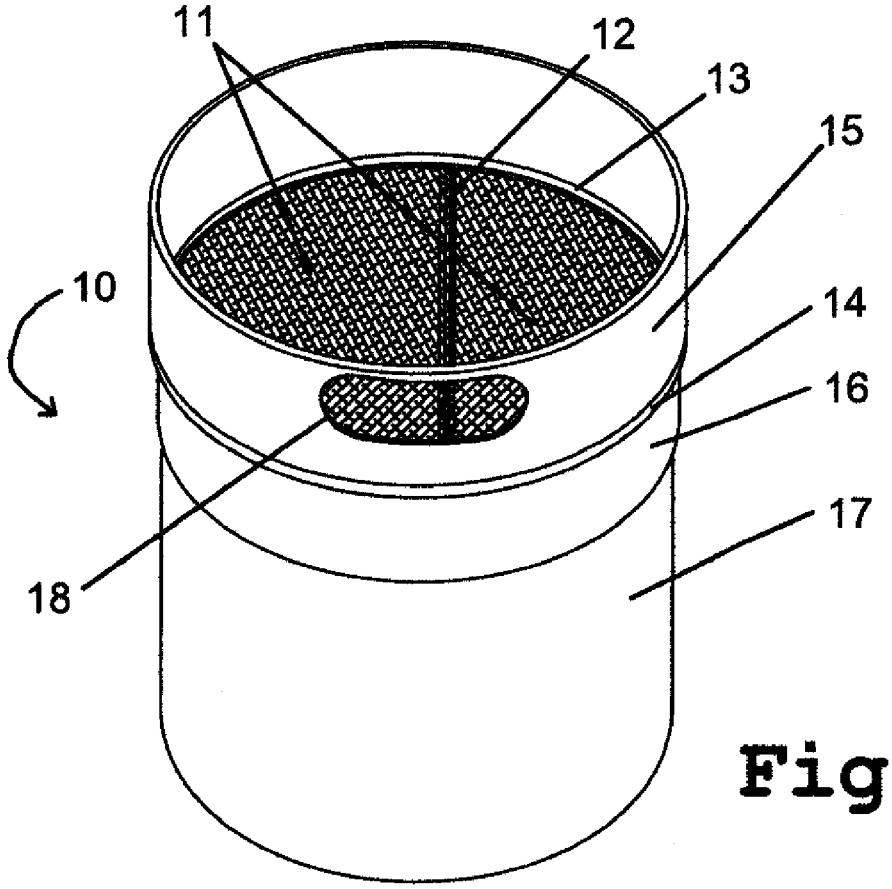
FIG. 1 is a side perspective view of a spill-resistant container, made in accordance with the present invention.

10 Spill-resistant container
11 Members of elasticized fabric
12 Placket
13 Upper annulus
14 Lower annulus
15 Upper circular wall
16 Lower circular wall with means for coupling incorporated therein
17 Receptacle
18 Cutout
19 Mouth

20 Means for coupling
21 Cover
22 Items
23 Cover where means for coupling is integrated with lower annulus.

DETAILED DESCRIPTION OF THE DRAWINGS

Figure 2:
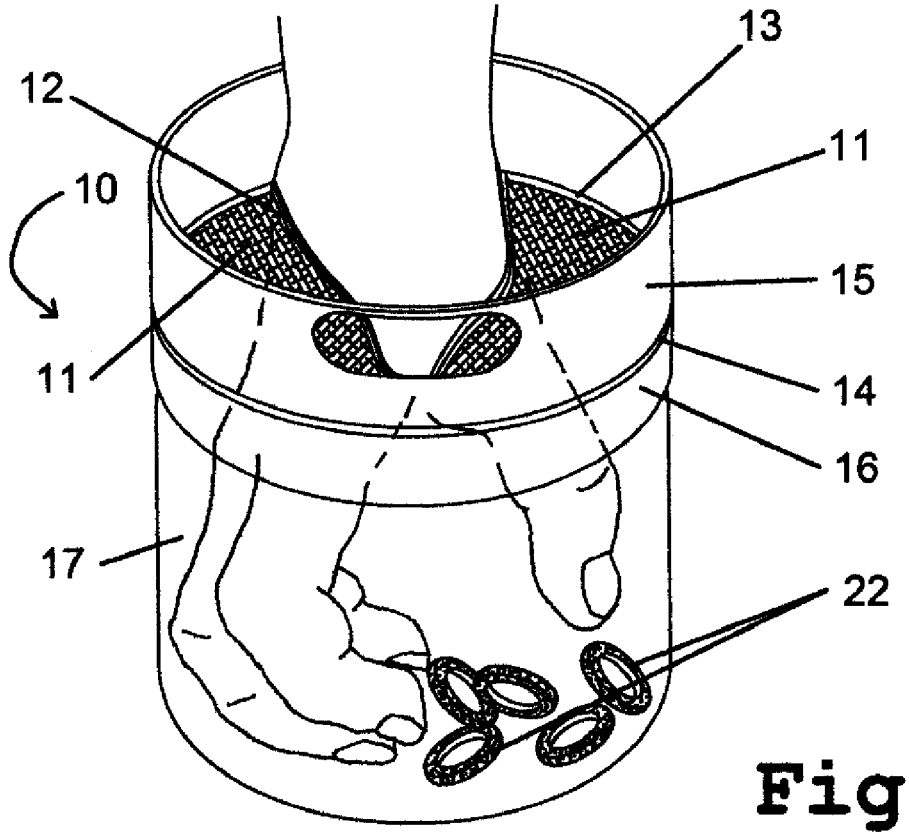
FIG. 2 is a similar view to FIG. 1, additionally showing a hand reaching into the container to retrieve items therefrom.

Referring now to the drawings in greater detail, and more specifically to FIGS. 1 and 2, there is shown a spill-resistant container 10, according to the present invention, having a multiplicity of items 22 therein which are accessed through the placket 12 formed by the elasticized fabric members 11. In FIGS. 1 and 2 the spill-resistant container 10 assembly is shown, consisting of a receptacle 17 within which items 22 are held. Above and, coupled to this receptacle 17, is a cover 21 which resists spills by maintaining two members of elasticized fabric 11 in suspension over the container. One member of elasticized fabric 11 overlaps the other 11 forming a placket 12. As seen in FIG. 1, a cutout 18 is also included in this assembly, to provide a handle, so that the user may easily grasp the spill-resistant container 10.

Referring now to FIG. 2, the spill-resistant container 10 is shown in use. The user may access items 22 in the receptacle 17 by slipping their hand through the placket 12, thus displacing the elasticized fabric members 11 horizontally and creating an opening. The elasticized fabric members 11 provide a soft, smooth opening for the user's hand to pass through. Additionally, because the fabric members 11 are easily stretched, movement of the user's hand is not restricted once inside the receptacle 17.

Figure 3:
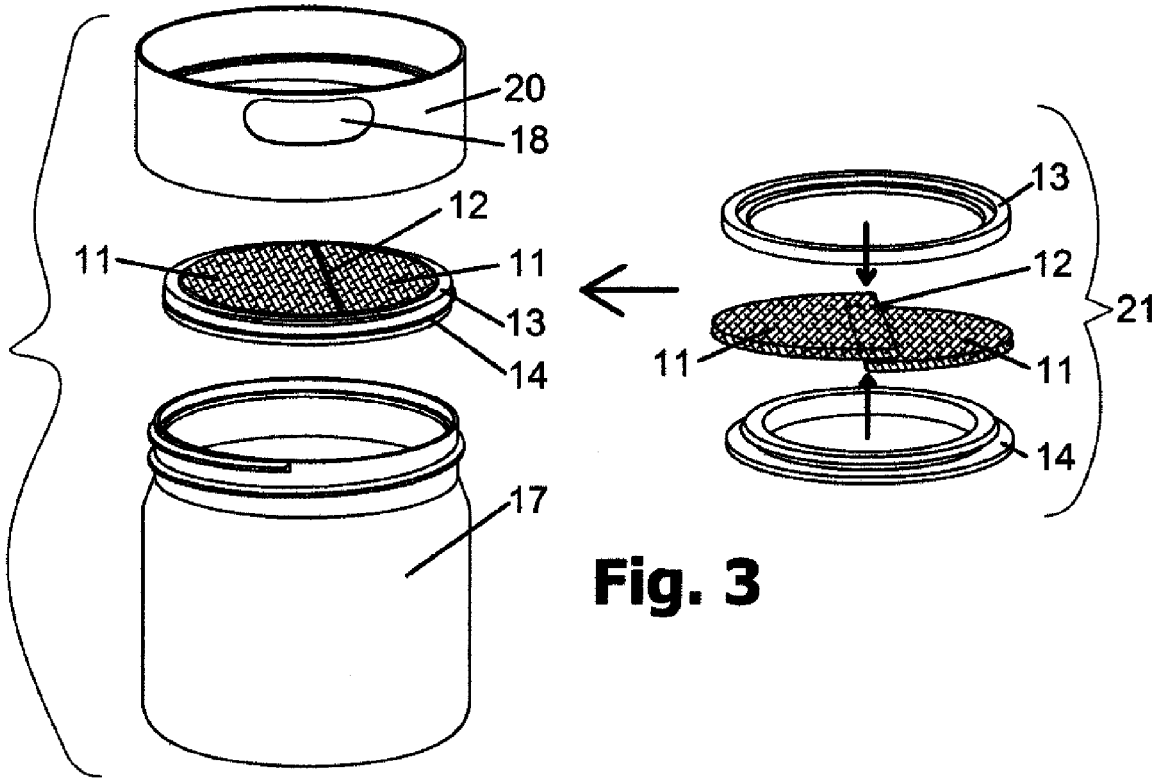
FIG. 3 is a side perspective view of a spill-resistant lid, made in accordance with the present invention, showing the layers of the lid construction, wherein the cover and means for coupling the lid to the container are separate units.
Figure 4:
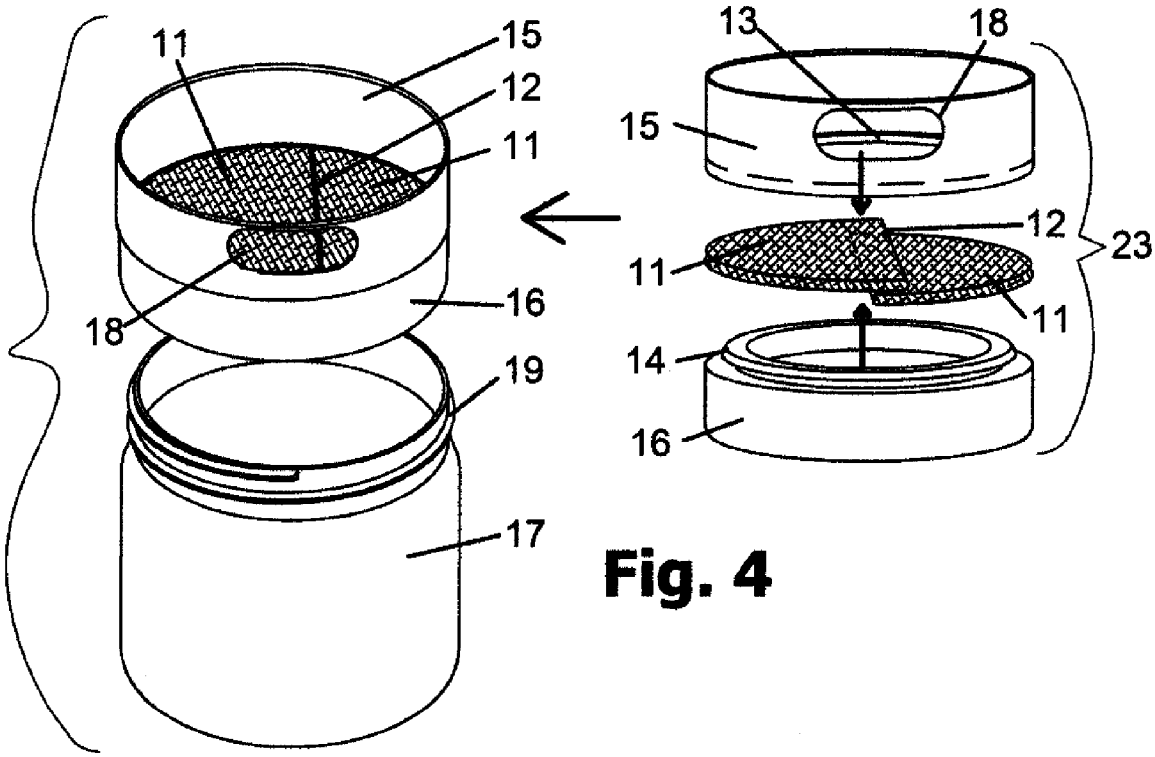
FIG. 4 is a view similar to FIG. 3, but shows the cover and means for coupling integrated in one unit.

FIGS. 3 and 4 illustrate the layers of construction of the spill-resistant container 10. The cover 21 is formed by sandwiching two members of elasticized fabric 11, one overlapping the other, forming a placket 12, between an upper annulus 13 and a lower annulus 14. The elasticized fabric 11 may be held between the annuli by a snap-together mechanism, adhesive, or stitching.

FIG. 3 shows the cover sandwiched between the means for coupling 20 above, and the mouth 19 of the receptacle 17 below. Here the cover 21 and the means for coupling 20 are separate units and the means for coupling 20 includes a cutout 18 to aid the user in holding the spill-resistant container 10.

Similar to FIG. 3, the FIG. 4, assembly 23 shows the upper 13 and lower 14 annuli with the addition of a circular wall molded to each. The means for coupling is formed within the lower circular wall 16, integrating the means for coupling with the annuli which suspend the fabric members 11. Additionally, a cutout 18 is formed within the upper circular wall 15.

While at least one preferred embodiment of the invention has been described in detail above, the same is by way of example and illustration only and the present invention is not limited thereto. The spill-resistant container 10 can be made in a variety of shapes and sizes to accommodate a variety of items 22 such as dry food snacks, paperclips, coins or children's toys.

The scope and content of the present invention are not intended to be limited by the foregoing descriptions, and are to be defined only by the appended claims and their legal equivalents.

I claim:

1. A spill-resistant container assembly comprising:

a receptacle, said receptacle being open at its upper end, having a quantity of removable items within;

a cover extending across and closing the open end of said receptacle, said cover including:

a peripheral lower annulus of predetermined height, width, and diameter, having ferruminated to it a wall, of predetermined height and width, and diameter equal to that of said lower annulus, extending downwardly, a means for coupling integrated therein;

two separate members of elasticized fabric, both positioned above said lower annulus in such a way that one member of elasticized fabric overlaps the other; and an upper annulus having ferruminated to it, a wall, of predetermined height and width, and diameter equal to that of said upper annulus, extending upwardly, including at least one cutout, said upper annulus being positioned above said members of elasticized fabric, and anchored to said lower annulus, whereby said members of elasticized fabric are sandwiched and suspended between said upper and said lower annuli.

* * * * *